US011193727B1

(12) United States Patent
Liu

(10) Patent No.: US 11,193,727 B1
(45) Date of Patent: Dec. 7, 2021

(54) PROTECTION DEVICE FOR CROSSBOW

(71) Applicant: Chi-Chang Liu, Taichung (TW)

(72) Inventor: Chi-Chang Liu, Taichung (TW)

(73) Assignee: Poe Lang Enterprise Co., LTD., Taichung (TW)

( * ) Notice: Subject to any disclaimer, the term of this patent is extended or adjusted under 35 U.S.C. 154(b) by 0 days.

(21) Appl. No.: 17/103,886

(22) Filed: Nov. 24, 2020

(51) Int. Cl.
*F41B 5/12* (2006.01)
*F41B 5/00* (2006.01)

(52) U.S. Cl.
CPC ..... *F41B 5/126* (2013.01); *F41B 5/00* (2013.01); *F41B 5/12* (2013.01)

(58) Field of Classification Search
CPC ..... F41B 5/26; F41B 5/12; F41B 5/00
USPC ..... 124/25.5, 25, 45, 49, 51.1, 52
See application file for complete search history.

(56) References Cited

U.S. PATENT DOCUMENTS 63,172 A * 3/1867 Nye ..... F41B 5/12 124/25
1,985,079 A * 12/1934 Conklin ..... F41B 5/126 124/25
2,516,341 A * 7/1950 Raffeis ..... F41B 5/12 124/49
2,554,966 A * 5/1951 Stevens ..... F41B 5/12 124/25
2,918,050 A * 12/1959 Kopman ..... F41B 5/12 124/25
3,739,765 A * 6/1973 Moore ..... F41B 5/126 124/25
3,968,783 A * 7/1976 Pfotenhauer ..... F41B 5/126 124/25
4,662,345 A * 5/1987 Stephens ..... F41A 9/70 124/25
5,544,641 A * 8/1996 Jenn ..... F41B 5/12 124/25
6,868,845 B1 * 3/2005 Moore ..... F41B 5/126 124/25
2015/0233666 A1 * 8/2015 Rodich ..... F41B 5/126 124/25

* cited by examiner

*Primary Examiner* — John E Simms, Jr.

(57) ABSTRACT

A crossbow includes a barrel with a flight groove, and a bow. A magazine is mounted to the body and located above the flight groove. A passage is defined through the magazine for accommodating multiple arrows therein. A slot is formed between the magazine and the flight groove. A string of the bow movably extends through the slot. An arm is pivotably located in the passage and includes a hook end which normally presses on a top-most arrow of the arrows in the magazine. When no arrow is in the magazine, the hook end is inserted into the slot and the user cannot successfully cock the string because the string is stopped by the hook end, so that the user is acknowledged that there is no arrow in the magazine.

10 Claims, 14 Drawing Sheets

PROTECTION DEVICE FOR CROSSBOW

BACKGROUND OF THE INVENTION

1. Fields of the Invention

The present invention relates to a protection device for a crossbow, and more particularly, to a protection that allows the users to shoot continuously, and prevents from proceeding shooting action when no arrows in the magazine.

2. Descriptions of Related Art

The conventional way to use the crossbow is to load an arrow into the flight groove on the barrel of the crossbow, and then cocking the arrow to pull the string. When pulling the trigger, the arrow is shot by the recovery force of the string. Then the user has to lower the crossbow and picks another arrow to load the arrow onto the crossbow as the steps mentioned previously. However, these repeated steps break the temple of the shooters and the crossbow has to be removed from the shooting position for reloading another arrow. In order to remove the shortcomings mentioned above, a magazine is chosen which has multiple arrows loaded therein so that the user is able to shoot the arrows continuously without interrupt as mentioned above.

Taiwanese patent number 1678510 discloses a pull arm which is combined with the string and includes a box which has one end thereof connected to the arm, and the other end of the box has a connection portion. The box includes a slot which extends through the box and communicates with the connection portion. The string of the crossbow operationally extends through the slot. A magazine is installed to the connection portion of the box and may be loaded with multiple arrows via an entrance of the magazine. A pressor is pivotably connected to the magazine and biased by a spring. The pressor is inserted into the entrance and presses the top-most arrow so as to feed the arrows one by one into the flight groove to be shot.

However, the user may not notice the arrows left in the magazine due to focusing on shooting action. When the user pulls the trigger while no arrow is fed from the magazine, the recovery force of the string is absorbed by the body of the crossbow and other parts, and the string may be damaged or even broken. Even worse, the parts may be splashed out and hit the user to become safety concerns.

The present invention intends to provide a protection device of a crossbow so as to eliminate shortcomings mentioned above.

SUMMARY OF THE INVENTION

The present invention relates to a crossbow and includes a barrel with a flight groove, and a bow is located at one end of the flight groove. A magazine is mounted to the barrel and located above the flight groove. A passage is defined through the magazine. Multiple arrows are piled and located within the passage. A slot is formed between the magazine and the flight groove. The string of the bow movably extends through the slot. An arm is pivotably located in the passage and includes a hook end which normally presses on a top-most arrow of the arrows in the magazine. When no arrow in the magazine, the hook end is inserted into the slot, and when the string is pulled in a direction opposite to the shooting direction of the crossbow, the hook end hooks the string of the bow. The user then cannot successfully cock the string because the string is stopped by the hook end, so that the user is acknowledged that there is no arrow in the magazine.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
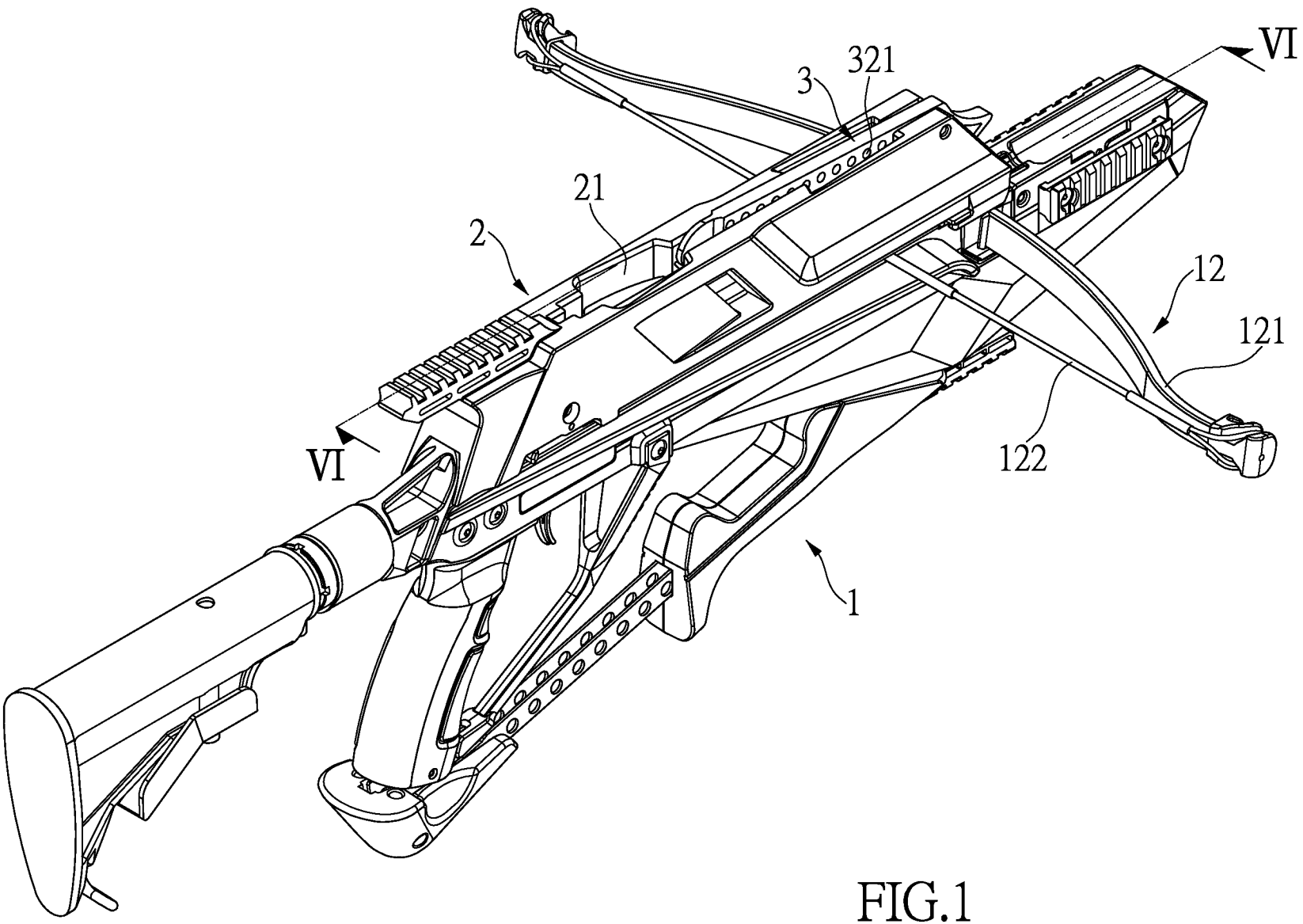
FIG. 1 is a perspective view to show the crossbow of the present invention.

Referring to FIGS. 1 to 10, the crossbow of the present invention comprises a barrel 1 having a flight groove 11 formed on the top thereof, and a bow 12 and a stock are respectively located at two ends of the barre 1. The bow 12 is located above the flight groove 11. A magazine 2 is mounted to the barrel 1 and located above the flight groove 11. A passage 21 is defined through the top and the bottom of the magazine 2 so that multiple arrows 22 can be piled and located within the passage 21. A slot 23 is formed between the magazine 2 and the flight groove 11. The bow 12 includes two limbs 121 and the string 122 which is connected between the two limbs 121. The barrel 1 of the crossbow is located between the two limbs 121. The string 122 movably extends through the slot 23.

An arm 3 is pivotably located in the passage 21 and includes a hook end 31 which normally presses on the top-most arrow of the arrows 22 in the magazine 2.

When there is no arrow in the magazine 2, the hook end 31 is inserted into the slot 23, such that when the user does not know there is no arrow in the magazine 2 and the string 122 is pulled in a direction opposite to the shooting direction of the crossbow (cocking the string), the hook end 31 hooks the string 122 of the bow 12 to restrict the string 122 from being further pulled. By this way, the user is acknowledged that there is no arrow in the magazine 2, the string 122 cannot be cocked. The user simply release the string 122 back to its initial position. Because the string 122 is just pulled a limited distance so that the problem described in the conventional crossbows can be avoided.

As shown in FIGS. 3 to 6, the arm 3 includes a press section 33 and a body portion 32. The body portion 32 is formed between the hook end 31 and the press section 33. The body 32 includes multiple bores 321 defined therethrough. A hole 24 is formed in each of two insides of the passage 21, so that a pin 34 extends through the two holes 24 and one of the bores 321 to pivotably position the arm 3 in the passage 21. The press section 33 partially protrudes beyond the passage 21 and includes an operation section 332 which can be pressed by the user to pivot the arm 3 from the slot 23 in a direction away from the passage 23. By inserting the pin 34 through different one of the bores 321, the length of the arm 3 in the passage 21 can be adjusted, so that the arrows 22 of different lengths can be loaded in the magazine 2 and properly pressed by the arm 3.

Figure 10:
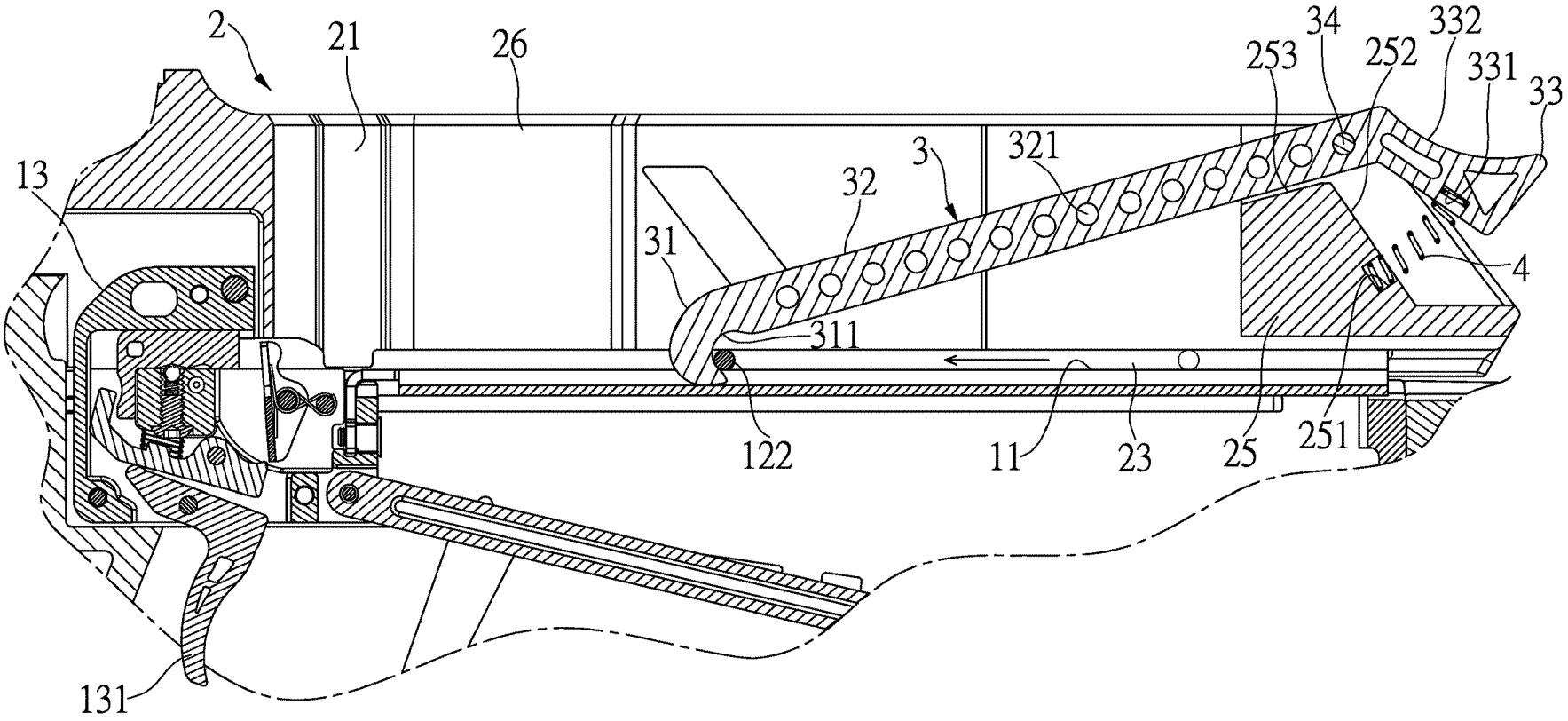
FIG. 10 is a cross sectional view to show that the arm is inserted in the slot.

As shown in FIGS. 6 to 9A, a block 25 is located in one end of the passage 21 and includes a first inclined face 252 and a second inclined face 253 which is formed with the first inclined face 252. A first dent 251 is defined in the first inclined face 252 faces the press section 33. The press section 33 includes a second dent 331 which is located corresponding to the first dent 251. Two ends of a spring 4 are respectively positioned in the first and second dents 251, 331. In other words, the arm 3 is pivotable about the pin 34 and the spring 4 pushes the press section upward so that the hook end 31 of the arm 3 is pivoted toward the slot 23. The arm 3 is always biased by the spring 4 to press the top most arrow 22 in the magazine even when the crossbow is tilt or unbalance, so that the arrows 22 do not drop out from magazine 2. As shown in FIG. 10, the arm 3 is naturally inserted into the slot 23 due to gravity and the force of the spring 4. When no arrow is in the passage 21 and the arm 3 is located in the slot 23 as mentioned before, the arm 3 is tilt and the body portion 32 of the arm 3 is not in contact with the second inclined face 253.

Figure 11:
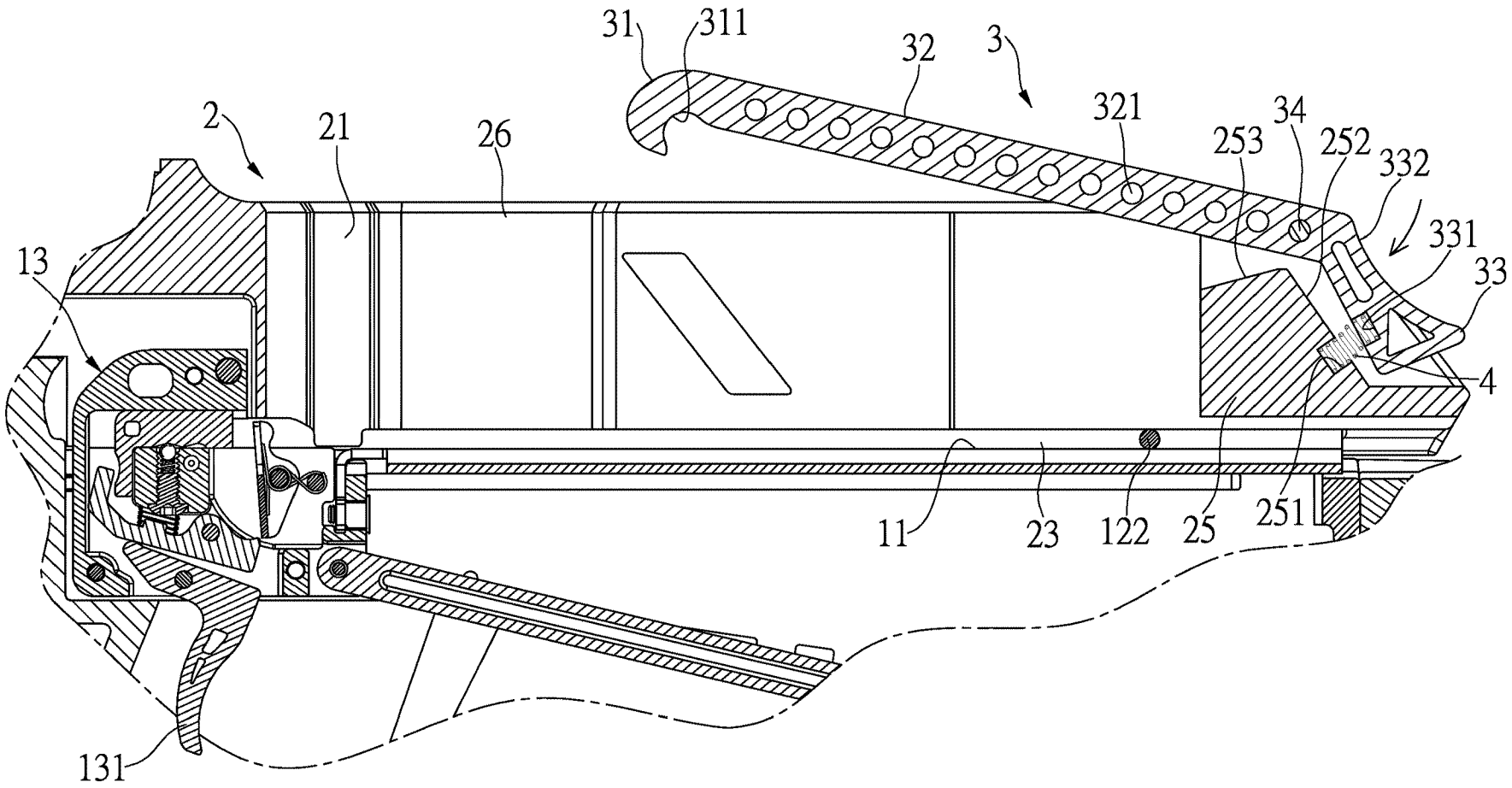
FIG. 11 is a cross sectional view to show that the arm is pivoted away from the passage when the press section is pressed.
Figure 12:
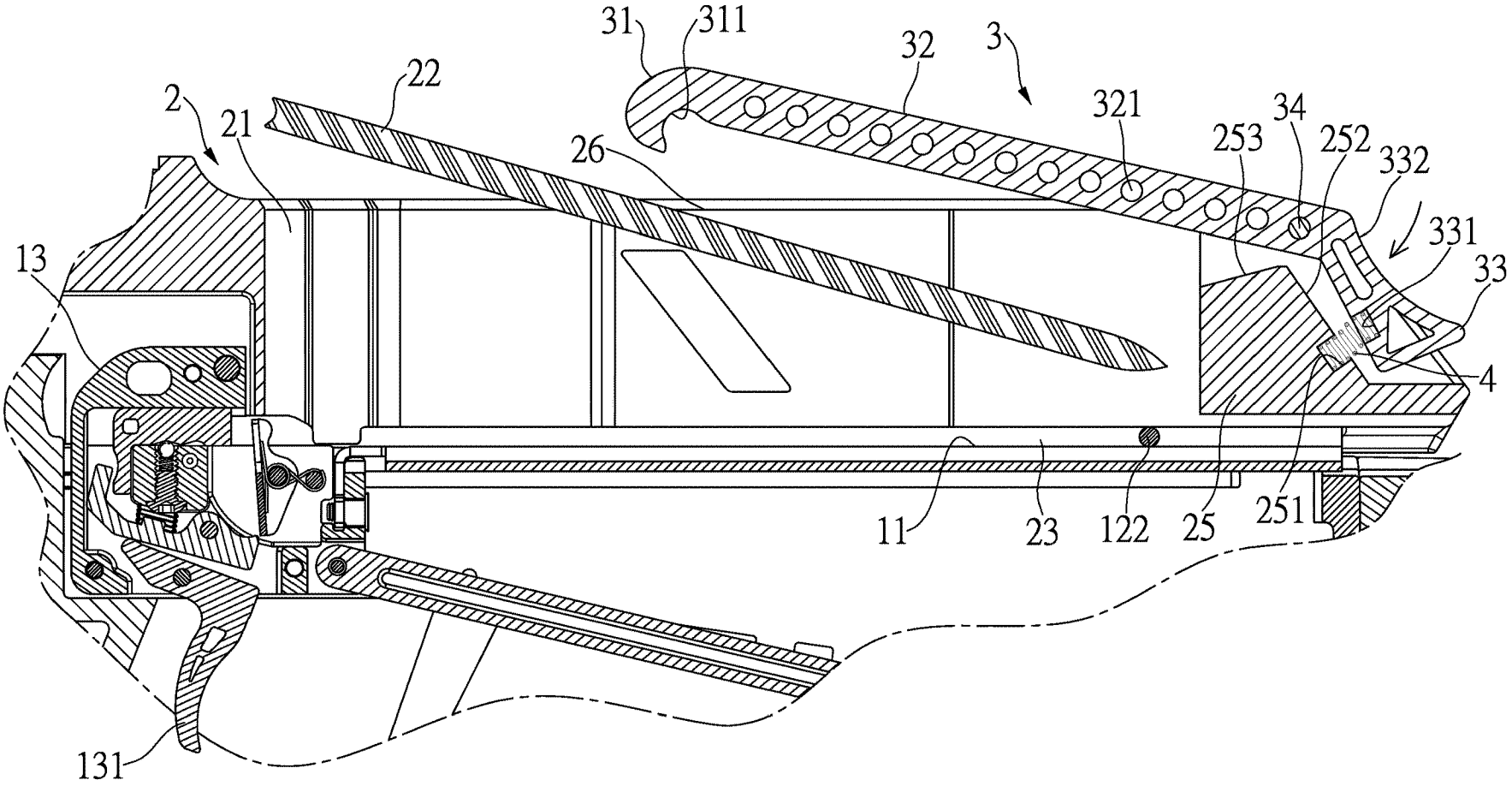
FIG. 12 is a cross sectional view to show that an arrows is loaded into the passage when the press section is pressed.
Figure 13:
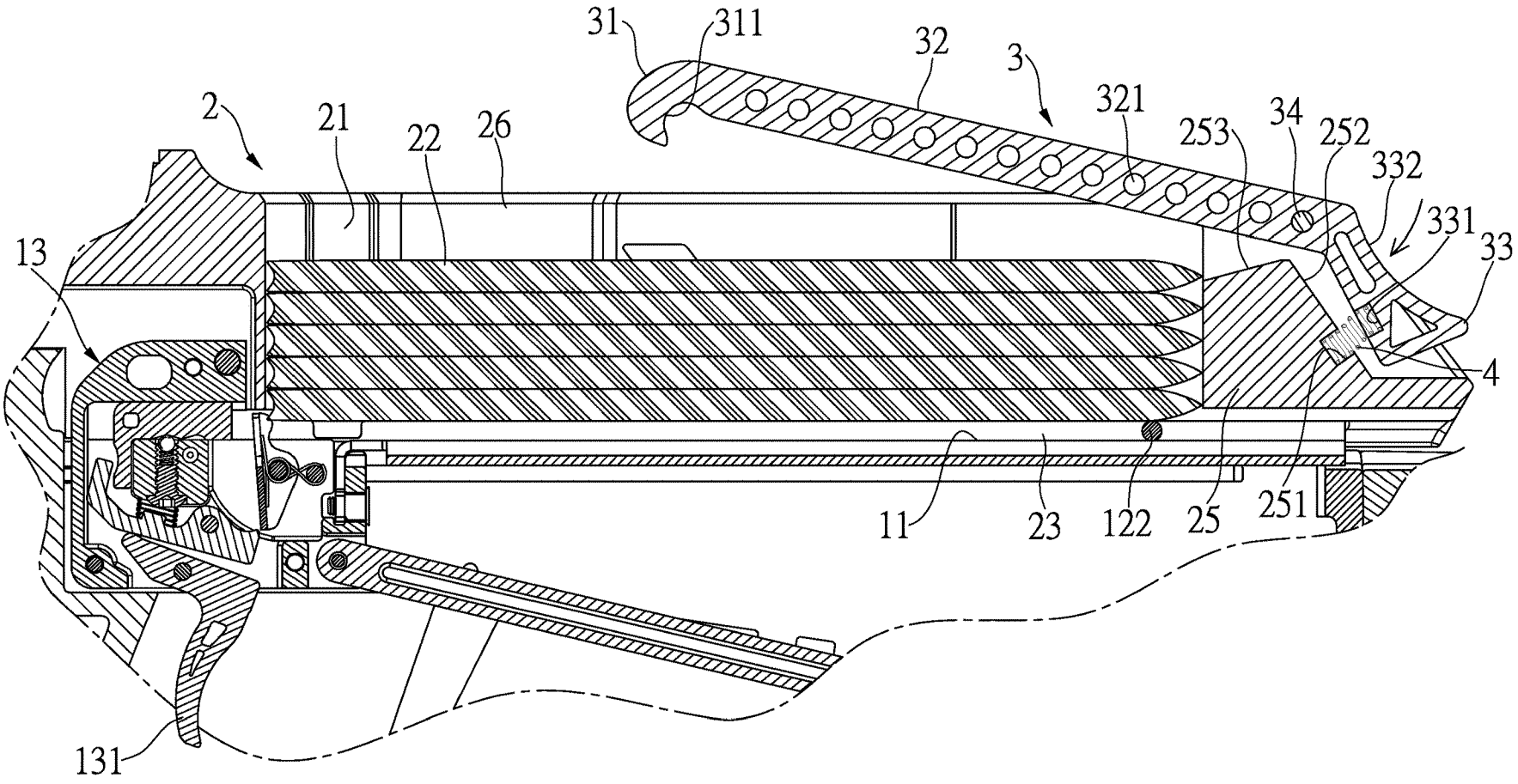
FIG. 13 is a cross sectional view to show that the magazine is fully loaded with arrows.

As shown in FIG. 11, the spring 4 is compressed when the operation section 332 of the press section 33 is pressed, and the arm 3 is pivoted from the slot 23 in a direction away from the passage 23. The arm 3 pivots downward into the magazine 2 when releasing the press section 33 to release the spring 4.

As shown in FIG. 10, the hook end 31 of the arm 3 includes a hooking portion 311. When there is no arrow in the magazine 2, the hook end 31 is located in the slot 23. When the string 122 is pulled, the string 122 is hooked by the hooking portion 311 of the hook end 31 located in the slot 23. Therefore, the string 122 cannot be further pulled, and the user knows that no arrow 1 is left in the magazine 2.

As shown in FIGS. 3 to 5, and 10 to 13, the passage 21 includes an entrance 26 and an exit 27. By pressing the operation section 332 of the press section 33 to pivot the arm 3 upward, arrows 22 can be loaded into the passage 21 via the entrance 26. After loading, the arm 3 presses on the top most arrow 22, and the lowest one of the arrows 22 drops into the slot 23 via the exit 27.

Figure 2:
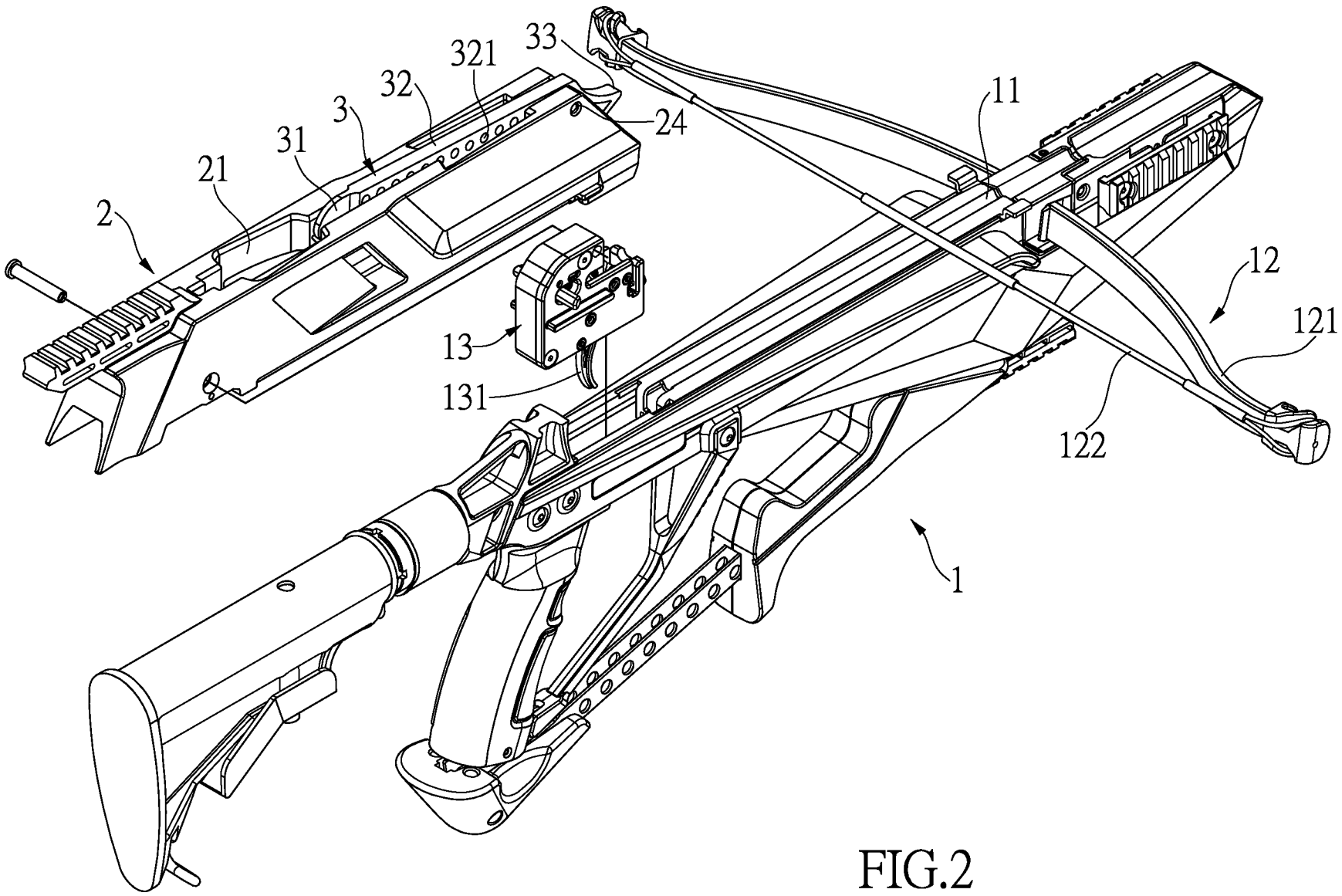
FIG. 2 is an exploded view of the crossbow of the present invention.
Figure 3:
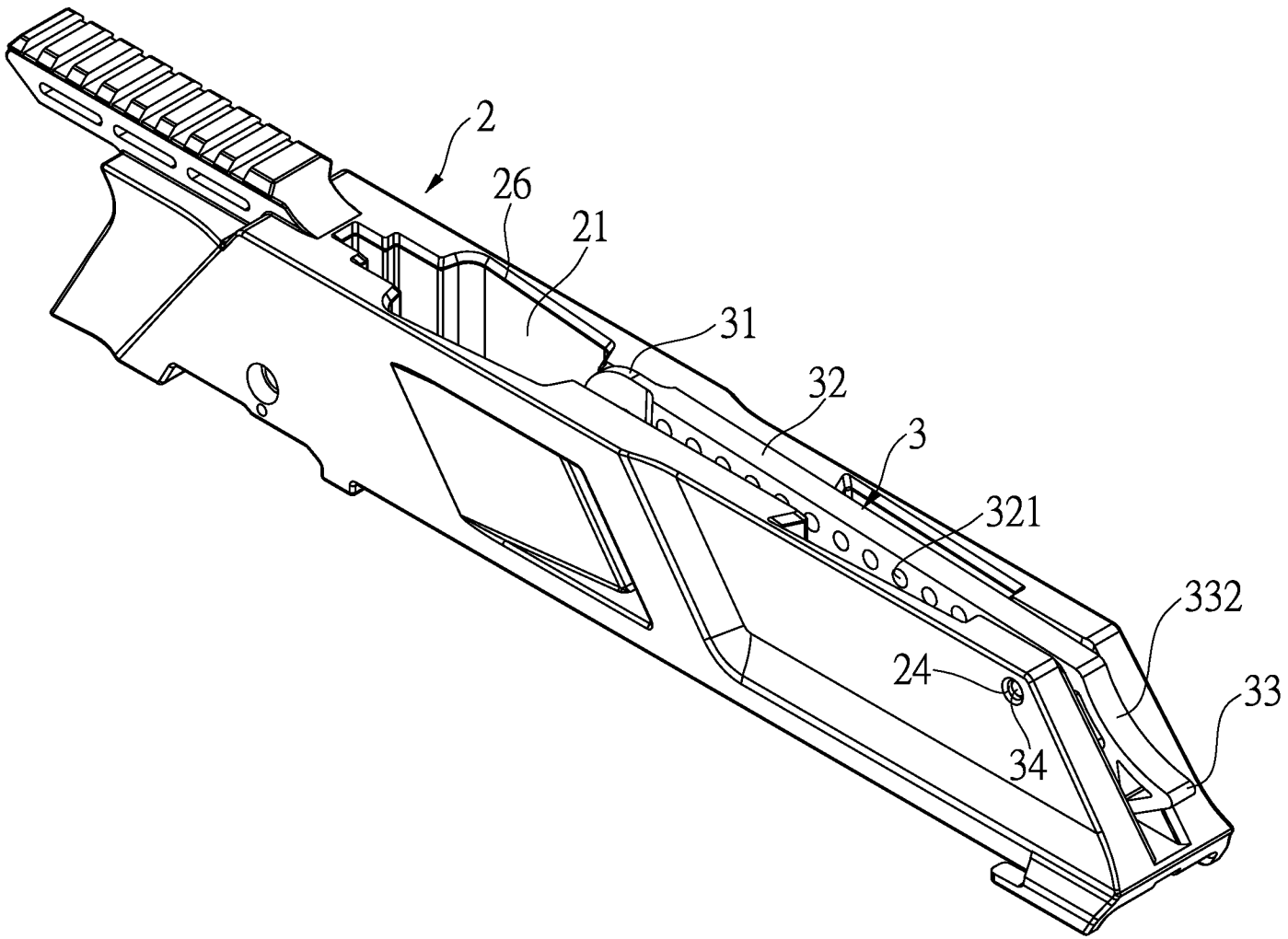
FIG. 3 is a perspective view to show the magazine and the arm of the crossbow of the present invention.
Figure 4:
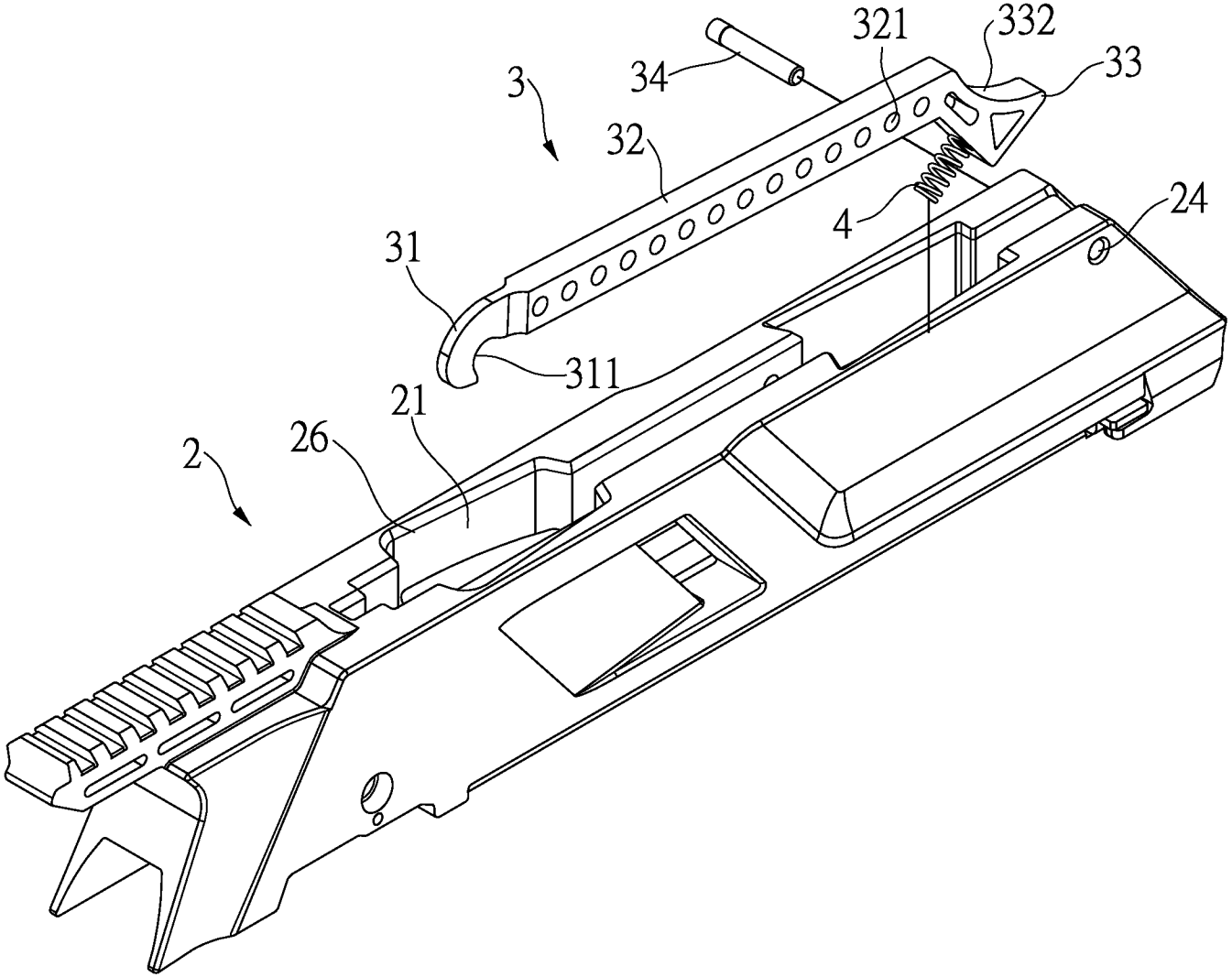
FIG. 4 is an exploded view to show the magazine and the arm of the crossbow of the present invention.
Figure 5:
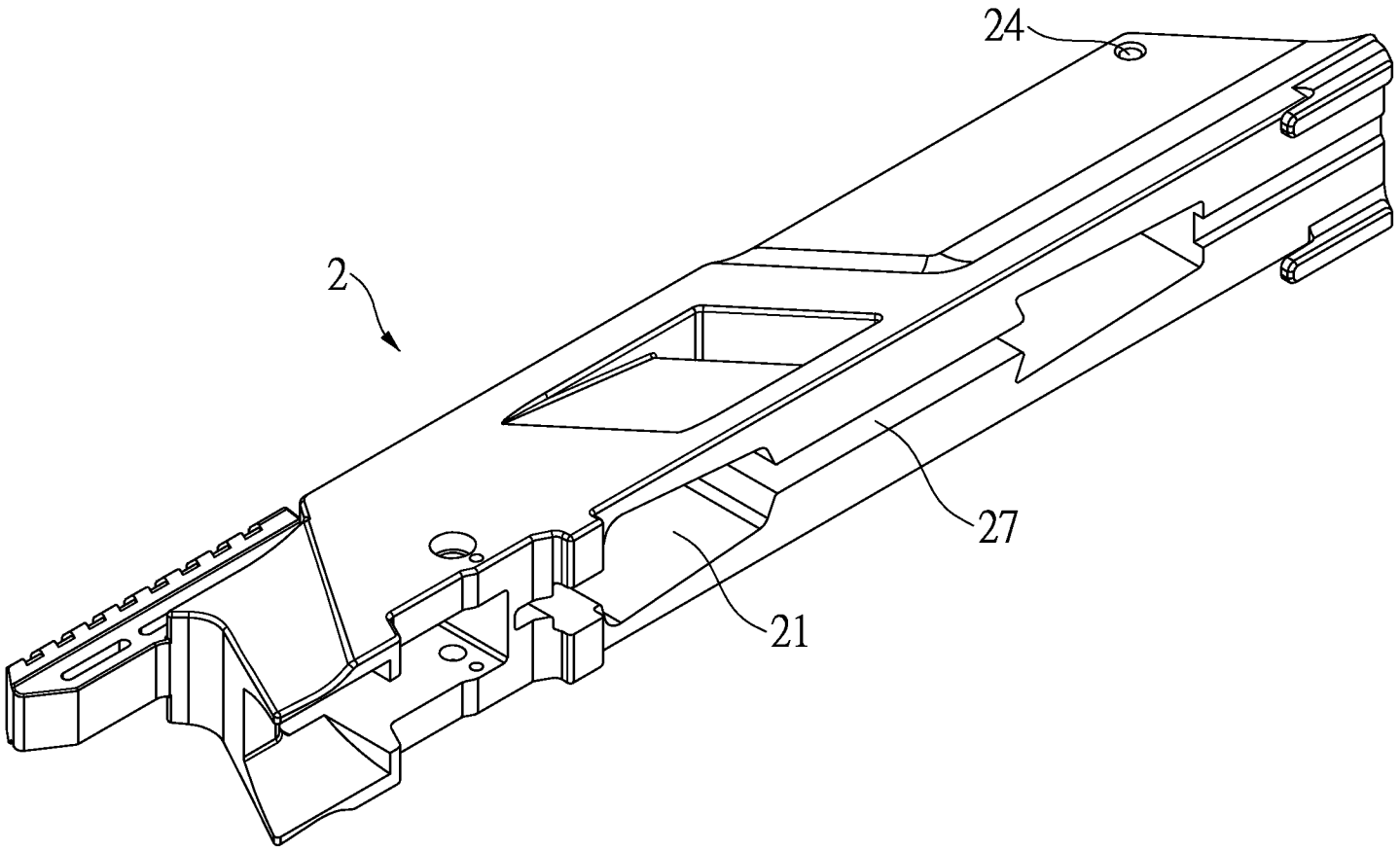
FIG. 5 show another perspective view of the magazine of the crossbow of the present invention.
Figure 6:
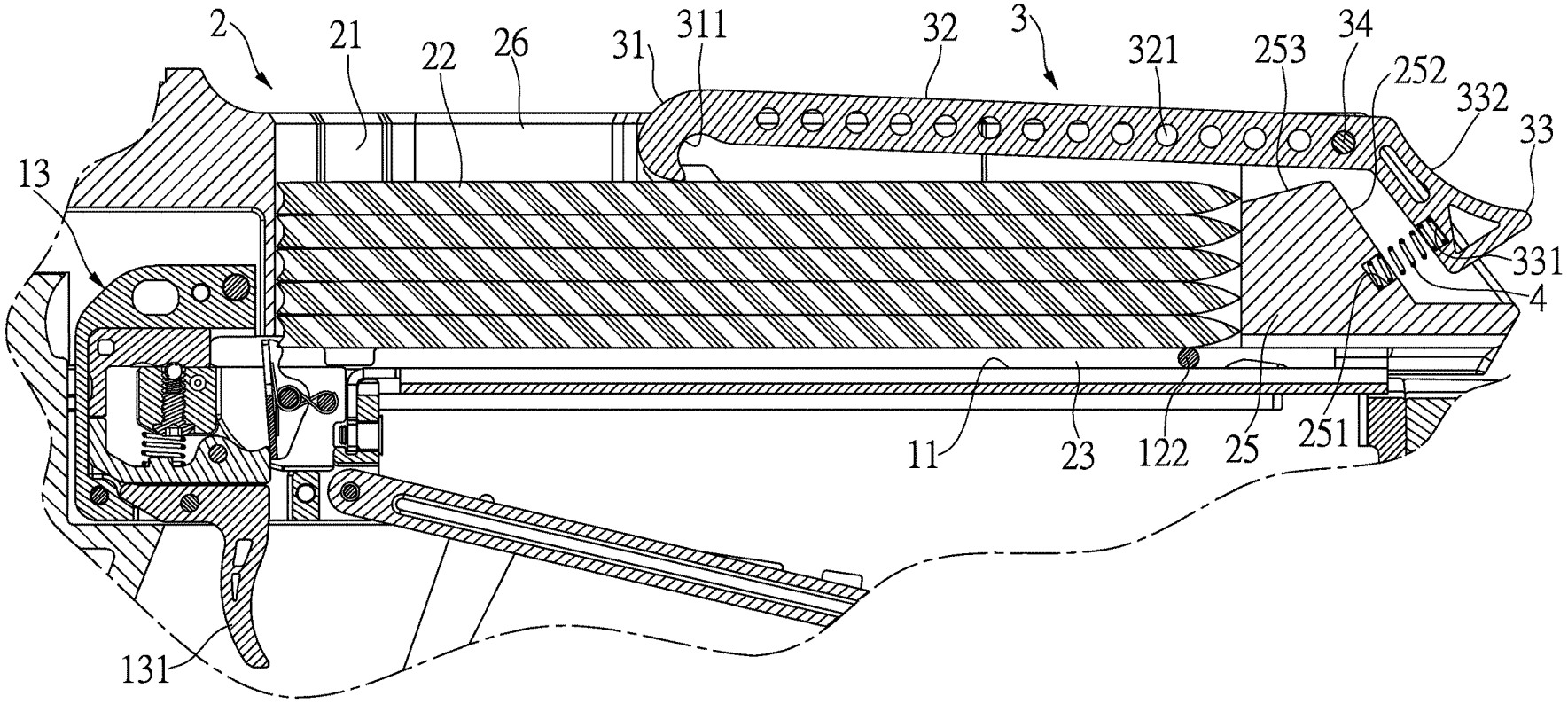
FIG. 6 is a cross sectional view, taken along line VI-VI in FIG. 1.
Figure 7:
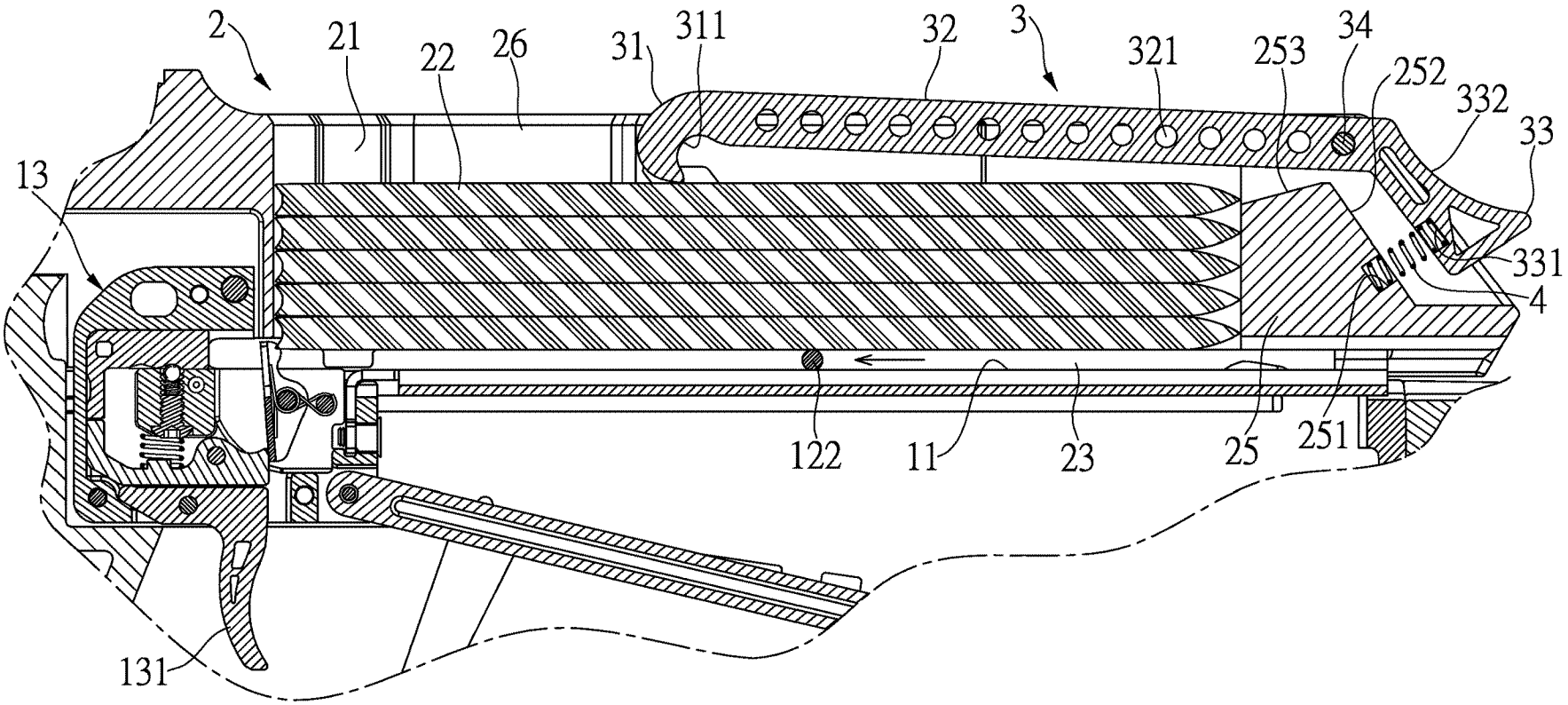
FIG. 7 is a cross sectional view to show that the string is pulled.
Figure 8:
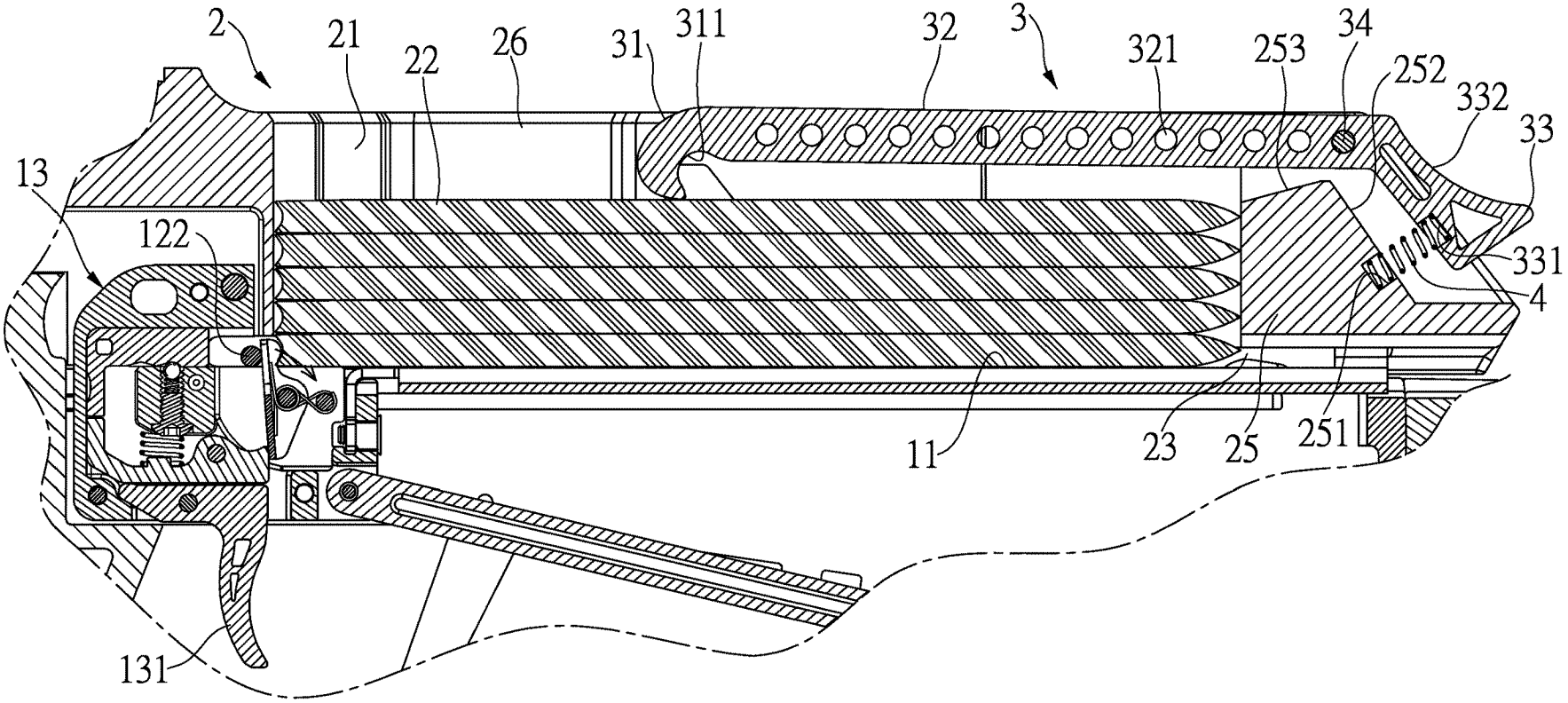
FIG. 8 is a cross sectional view to show that the string is cocked.
Figure 9:
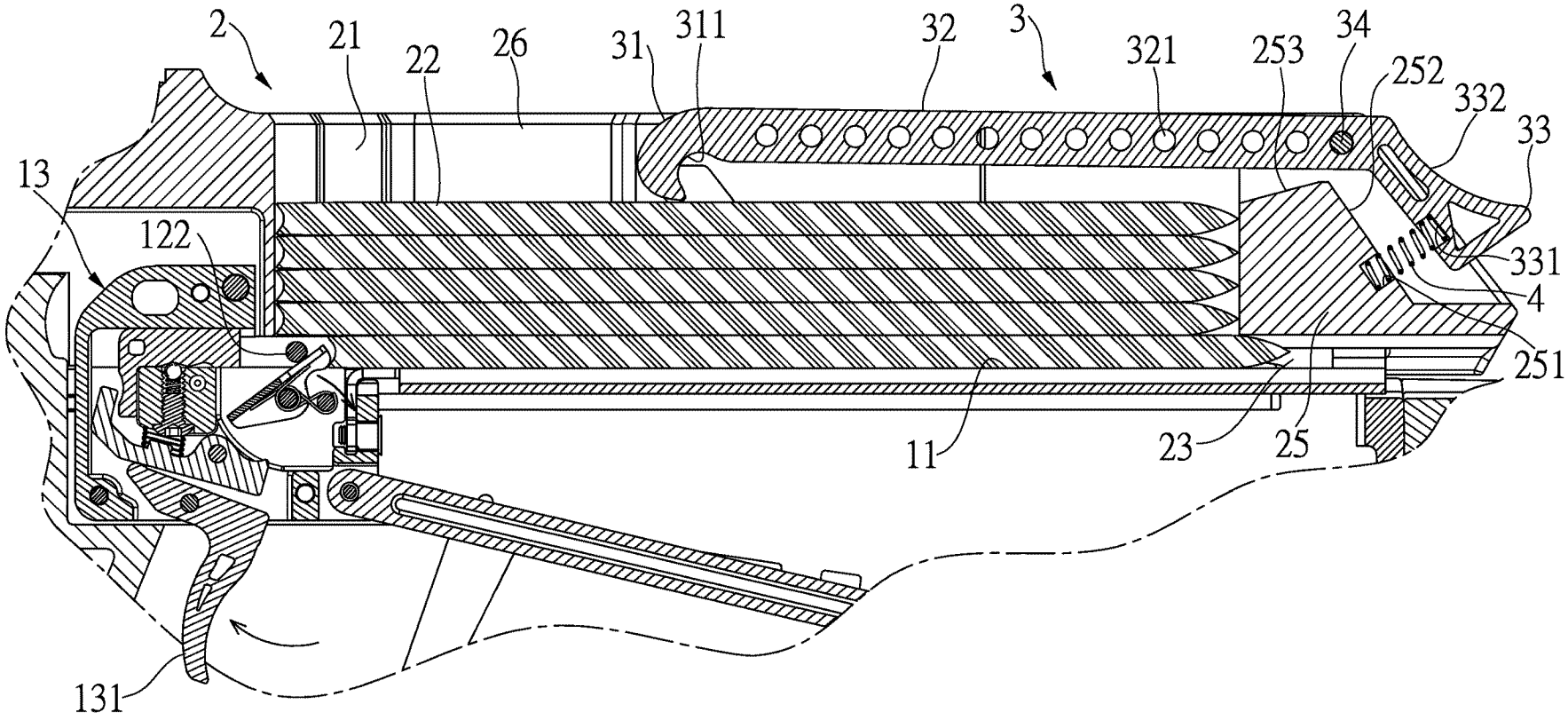
FIG. 9 is a cross sectional view to show that the trigger is pulled.
Figure 9A:
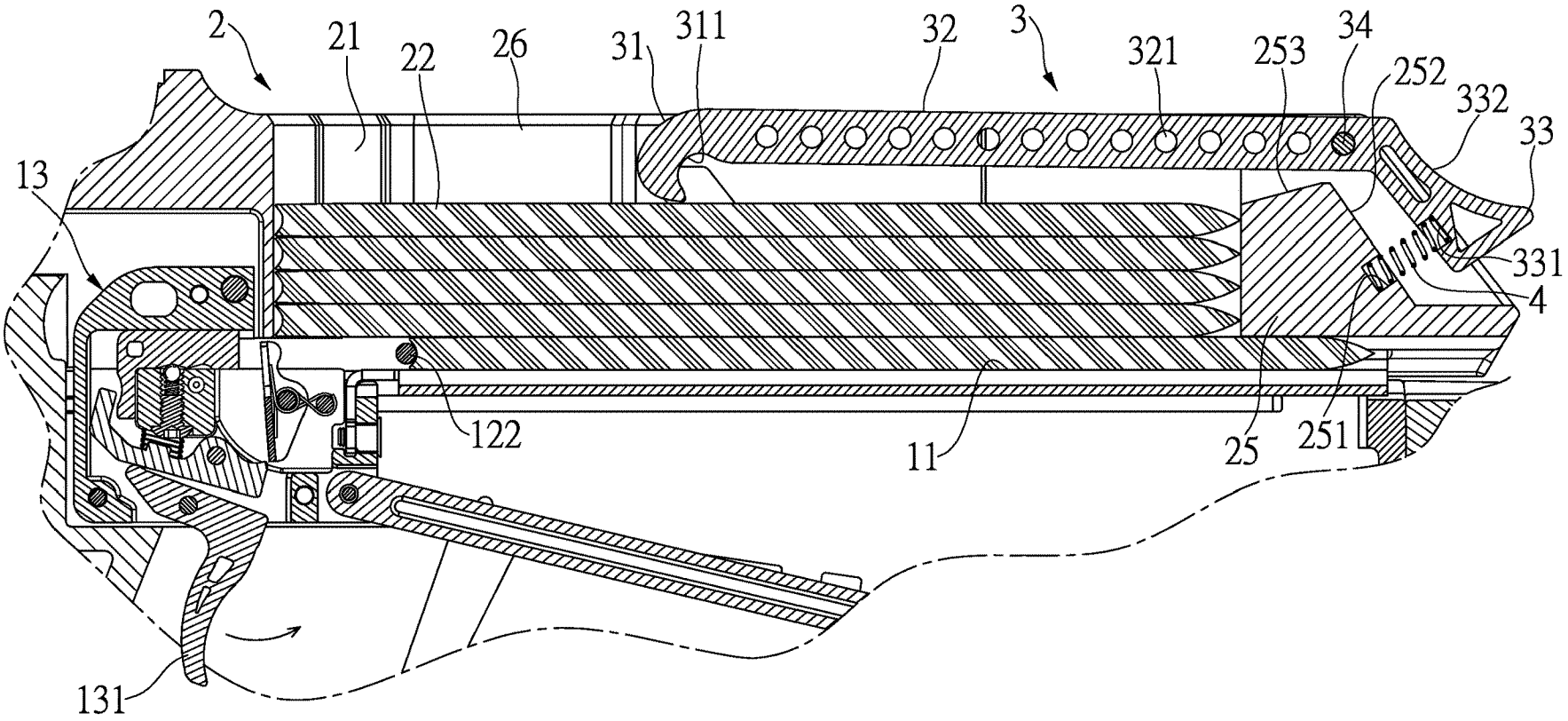
FIG. 9A is a cross sectional view to show that the string is released to push an arrow.

Further referring to FIGS. 1 and 2, the crossbow includes a trigger unit 13 which includes a trigger 131. As shown in FIGS. 6 to 9A, when the string 122 is cocked, the bottom most arrow 22 is located in the slot 23, the trigger 131 is pulled by the user to release the string 122 to shoot the arrow 22 in the slot 23. Then the bottom most arrow 22 drops into the slot 23 by the pressing force of the arm 3, the user does not need to re-load the arrow 22 to shorten the shooting time between shoots.

The present invention provides the protection device that arranges the arm 3 to be located in the slot 23 so that the user is acknowledged that there is no arrow 2 in the magazine 2 because the string 122 cannot be successfully cocked.

While we have shown and described the embodiment in accordance with the present invention, it should be clear to those skilled in the art that further embodiments may be made without departing from the scope of the present invention.

What is claimed is:

1. A crossbow comprising:

a barrel having a flight groove, a bow located at one end of the flight groove;

a magazine mounted to the barrel and located above the flight groove, a passage defined through a top and a bottom of the magazine, multiple arrows piled and located within the passage, a slot formed between the magazine and the flight groove, a string of the bow movably extending through the slot, and an arm pivotably located in the passage and including a hook end which normally presses on a top-most arrow of the arrows in the magazine, when no arrow in the magazine, the hook end is inserted into the slot, and when the string is pulled in a direction opposite to a shooting direction of the crossbow, the hook end hooks the string of the bow.

2. The crossbow as claimed in claim 1, wherein the arm includes a press section and a body portion, the body portion is formed between the hook end and the press section, the body portion is pivotably located in the passage by a pin.

3. The crossbow as claimed in claim 2, wherein the press section partially protrudes beyond the passage, the press section includes an operation section which is pressed to pivot the arm from the slot in a direction away from the passage.

4. The crossbow as claimed in claim 2, wherein a block is located in one end of the passage and includes a first dent which faces the press section, the press section includes a second dent which is located corresponding to the first dent, two ends of a spring are respectively positioned in the first and second dents, the hook end of the arm is biased by the spring to pivot toward the slot.

5. The crossbow as claimed in claim 4, wherein the spring is compressed when the operation section of the press section is pressed.

6. The crossbow as claimed in claim 4, wherein the block includes a first inclined face and a second inclined face which is formed with the first inclined face, the first dent is defined in the first inclined face, when no arrow in the passage and the arm is located in the slot, the arm is tilt and the body portion of the arm is not in contact with the second inclined face.

7. The crossbow as claimed in claim 1, wherein the passage includes an entrance and an exit, the arrows are loaded into the passage via the entrance, a lowest one of the arrows drop into the slot via the exit.

8. The crossbow as claimed in claim 2, wherein the body includes multiple bores defined therethrough, a hole is formed in each of two insides of the passage, the pin extends through the two holes and one of the bores.

9. The crossbow as claimed in claim 1, wherein the bow includes two limbs and the string is connected between the two limbs, the barrel of the crossbow is located between the two limbs, the string movably extends through the slot.

10. The crossbow as claimed in claim 8, wherein the hook end of the arm includes a hooking portion, when no arrow in the magazine, the hook end is located in the slot; when the string is pulled, the string is hooked by the hooking portion of the hook end.

* * * * *